United States Patent [19]

Blanes

[11] Patent Number: 5,072,934

[45] Date of Patent: Dec. 17, 1991

[54] MULTIPLE USE EXERCISE DEVICE

[76] Inventor: Gary W. Blanes, 1755 Langan, Port Coquitlam, B.C., Canada, V3C 1K8

[21] Appl. No.: 669,781

[22] Filed: Mar. 15, 1991

[51] Int. Cl.[5] ..... A63B 21/06

[52] U.S. Cl. ..... 272/117; 272/900; 272/136

[58] Field of Search ..... 272/136, 900, 62, 117, 272/118, 128

[56] References Cited

U.S. PATENT DOCUMENTS

| | | | |
|---|---|---|---|
| 2,134,451 | 10/1938 | Mogren | 272/57 |
| 2,959,414 | 11/1960 | Saltz | 272/83 |
| 3,979,114 | 9/1976 | Codina | 272/126 |
| 4,072,308 | 2/1978 | Applegate | 272/117 |
| 4,109,907 | 8/1978 | Zito | 272/117 |
| 4,229,002 | 10/1980 | Masters | 272/117 |
| 4,344,618 | 8/1982 | Dudley | 272/117 |
| 4,619,453 | 10/1986 | Plumridge | 272/117 |
| 4,722,523 | 2/1988 | Yang | 272/122 |
| 4,826,153 | 5/1989 | Schalip | 272/118 |
| 4,974,836 | 12/1990 | Hirsch | 272/117 |

*Primary Examiner*—Richard J. Apley
*Assistant Examiner*—J. Donnelly
*Attorney, Agent, or Firm*—Townsend and Townsend

[57] ABSTRACT

A compact multiple use exercise device removably secured in doorway, comprising a telescopically adjustable chinning bar which locks at any longitudinal increment allowing it to be adjusted to fit different doorway widths. The bar is supported at each end in the doorway by hangers which have open tops to allow the bar to be easily removed and stored when not in use. Weight resistance is provided by standard weight plates which are placed on the carrier which is coupled to a cable which runs through a first pulley attached to the chinning bar, and optionally through a second pulley, and attaches to a handle, lat bar, or leg strap depending on which exercise is desired. With the cable running through the first pulley, an upward and lateral resistance is created which may be used for exercises which simulate golf, baseball, swimming and throwing; as well as several standard weight training exercises. The second pulley may be positioned to change the direction of resistance on the cable to an upward, downward or lateral direction. Rowing exercises are also possible when the second pulley is attached to a telescoping lat bar which may be held low to the floor at each side of the door frame.

14 Claims, 9 Drawing Sheets

MULTIPLE USE EXERCISE DEVICE

FIELD OF INVENTION

The present invention relates to a multiple use exercise device for installation in a doorway. More specifically the present invention provides an exercise device for home use which has a number of components that can be arranged in different ways for different exercises.

BACKGROUND OF INVENTION

Many types of multiple exercise devices exist. Examples include U.S. Pat. No. 3,979,114 to Codina, U.S. Pat. No. 4,072,308 to Applegate and U.S. Pat. No. 4,109,907 to Zito. In each of these cases the exercise device is arranged to be supported from the top of a door, generally when the door is closed in the door frame. In U.S. Pat. No. 4,344,618; to Dudley, U.S. Pat. No. 4,619,453 to Plumridge and U.S. Pat. No. 4,722,523 to Yang exercising devices are shown which are supported in the frame or jambs of a doorway. In these cases, there are anchors or the like fitted to the door frame and removable bars or other components that are supported from these anchors. Most of these units that are known today lack simplicity, versatility and consideration for the structural integrity of the door frames to which the devices are attached.

SUMMARY OF INVENTION

For the present invention there is provided a multiple use exercise device which utilizes the frame of a door to eliminate the need for bulky and expensive structural frames as part of the device. The unit is sold in kit form with a number of components that can be mounted in a doorway. Certain elements or anchors are required to be attached to the jambs of the doorway permitting the exercise device to be easily installed when needed and quickly removed after use. By utilizing the door frame, one eliminates the need for bulky and expensive structural frames as part of the device. This reduces the cost and the amount of space required to use and store the device thus, makes it suitable for those living in apartments.

The multiple use exercise device of the present invention provides a means to change the amount of resistance and the direction of the resistance in an upward, downward or lateral direction, and yet is simple, practical, safe and versatile. The device does not put excessive outward pressure on the door frames which can cause the door frames to separate or deform, neither does it place a downward force on the doors which results in screws holding the hinges to the door or the jamb to loosen. The loads placed on the frame are easily transferred to the floor and the wood framing behind the jambs. These loads are at least partially counter balanced by the interaction between the user and the device.

The present invention provides an exercise device adapted for installation in a doorway, comprising in combination a first elongate bar having a telescopically adjustable length, a first support for each end of the first bar, the first support adapted for attachment on both jambs of the doorway, first pulley supported at a first position on the first elongate bar, weight plate carrier adapted to hold a plurality of weights, cable having a gripping handle at one end passing over the first pulley and at the other end connected to the weight plate carrier, a first hook located at a second position at one end of the first elongate bar, second elongate bar having telescopically adjustable length, the second bar having a second hook at the approximate center of the bar, second support for each end of the second bar, the second support adapted for attachment on both jambs of the doorway below the first support, and second pulley for detachably mounting on either the first hook or the second hook, the second pulley adapted to allow the cable to pass therearound.

BRIEF DESCRIPTION OF DRAWINGS

In drawings which illustrate embodiments of the present invention.

MODES FOR CARRYING OUT THE INVENTION

A number of components make up the exercise device of the present invention. These components are generally sold in kit form and permit different arrangements of exercising, with variable resistance in an upward, downward or lateral direction. Before use it is necessary to have some attachments or anchors in the jambs of a door. These attachments can generally remain in place as they have little restriction on access through the doorway and do not affect the closing of the door in the door frame.

Figure 1:
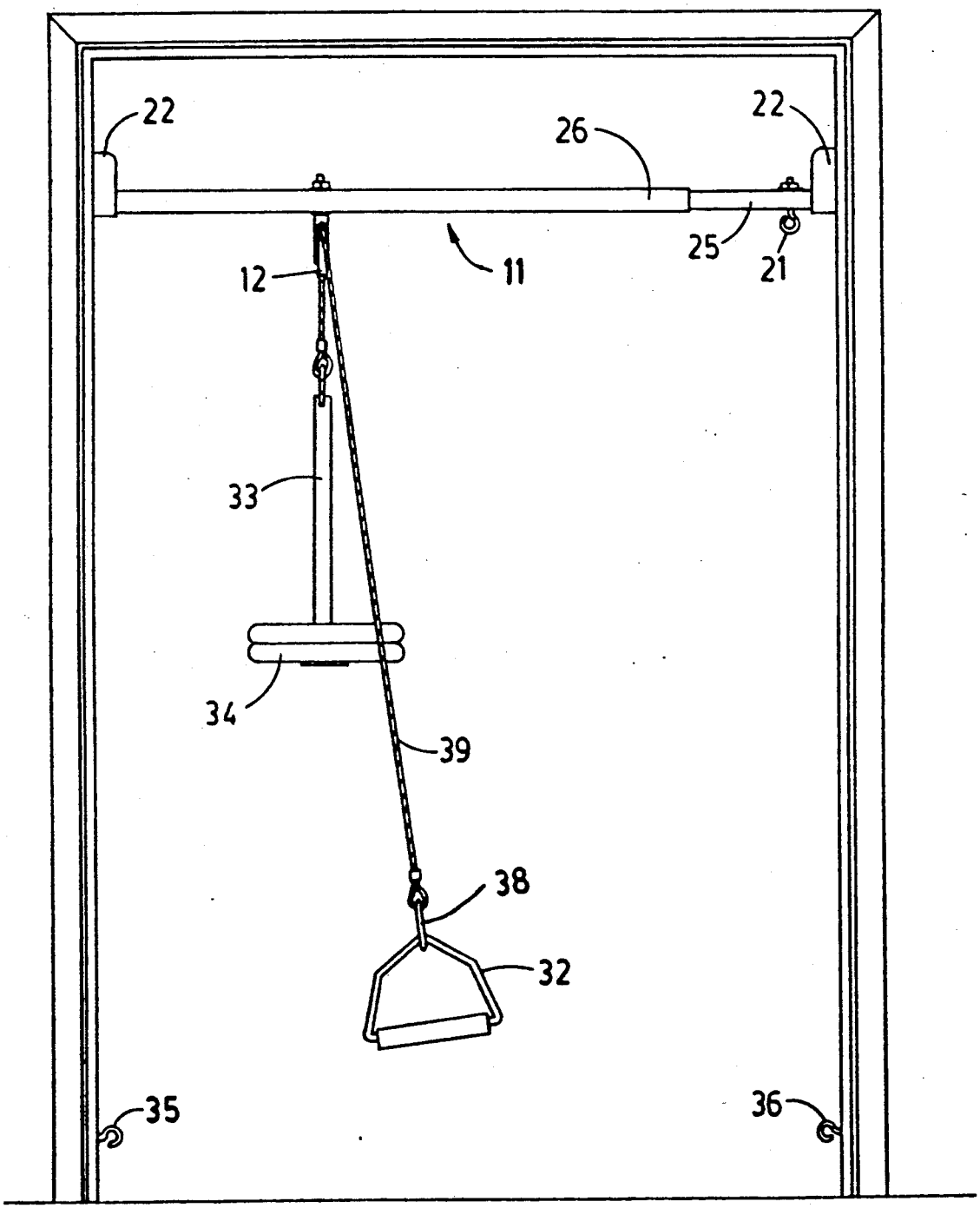
FIG. 1 is a front elevational view of a door frame showing a chinning bar with pulley attachments, hanger brackets, a weight cable and gripping handle all forming one embodiment of the present invention, installed in a door frame.

FIG. 1 shows an embodiment wherein a chinning bar 11 or first elongate bar is positioned in a doorway. The chinning bar assembly 11 is a telescopic unit having an inner tube 25 that telescopes within an outer tube 26. The chinning bar assembly 11 is supported by brackets 22 which are attached to each door jamb directly opposite to each other. A first pulley 12 is supported from the chinning bar 11. A cable 39 passes over the pulley 12 and is attached at one end to a weight plate carrier 33 having, as shown, two weights 34 thereon. The weights are of the known disk type having a hole through the center. Different thicknesses of weight represent different weights and the desired weight can be selected by varying the number of weights and the types of weights on the weight carrier 33. At the other end of the cable 39 a connector piece 38 joins to a D-type gripping handle 32. By pulling on the handle 32, the cable 39 moves over the pulley 12, raising the weights 34 on the carrier 33.

Figure 2:
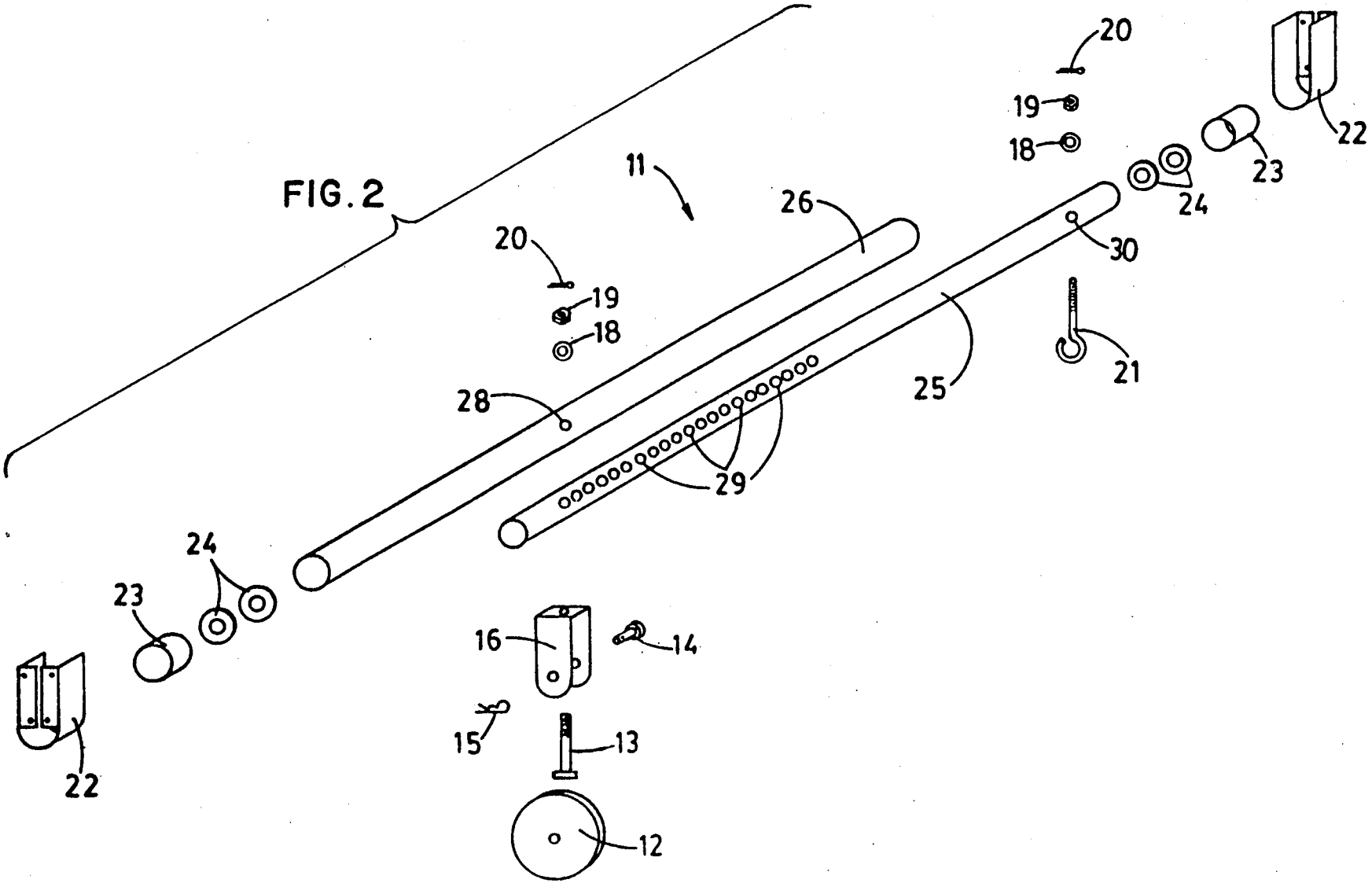
FIG. 2 is an exploded isometric view showing the different elements of the chinning bar, pulley attachment and hanger brackets illustrated in FIG. 1.

The chinning bar 11 is shown in more detail in FIG. 2. The inner tube 25 is shown to have a plurality of holes 29 in a row. When the inner tube is telescoped within the outer tube 26, then a single hole 28 shown in the outer tube extends through both sides of the tube and is aligned with one of the holes 29 in the inner tube 25. This alignment is dependent upon the width of the door frame. The width must be slightly less to allow for shims 24 as shown on both ends of the inner tube 25 and outer tube 26. Caps are placed over the ends of the tubes 25 and 26 to make up the exact distance between the brackets 22 for supporting the chinning bar 11. When holes 28 and 29 are aligned a bolt 13 passes through a U-shaped bracket 16 and the aligned holes and a washer 18, nut 19 and spring clip 20 are provided to hold the assembly in place as shown in more detail in FIG. 3. A pin 14 passes through a hole in the sides of the U-shaped bracket 16 and the pulley 12 with a spring clip 15 to hold the pin 14 in place. The pulley 12 freely rotates on the pin 14.

U-shaped brackets 22 are shown for supporting the chinning bar 11 on each side. Screws (not shown) are provided for screwing into the opposing door jambs at the same height. The assembled chinning bar 11 is then placed into these U-shaped support brackets 22 which retain the bar in place as the weight is downwards on the brackets 22.

Figure 3:
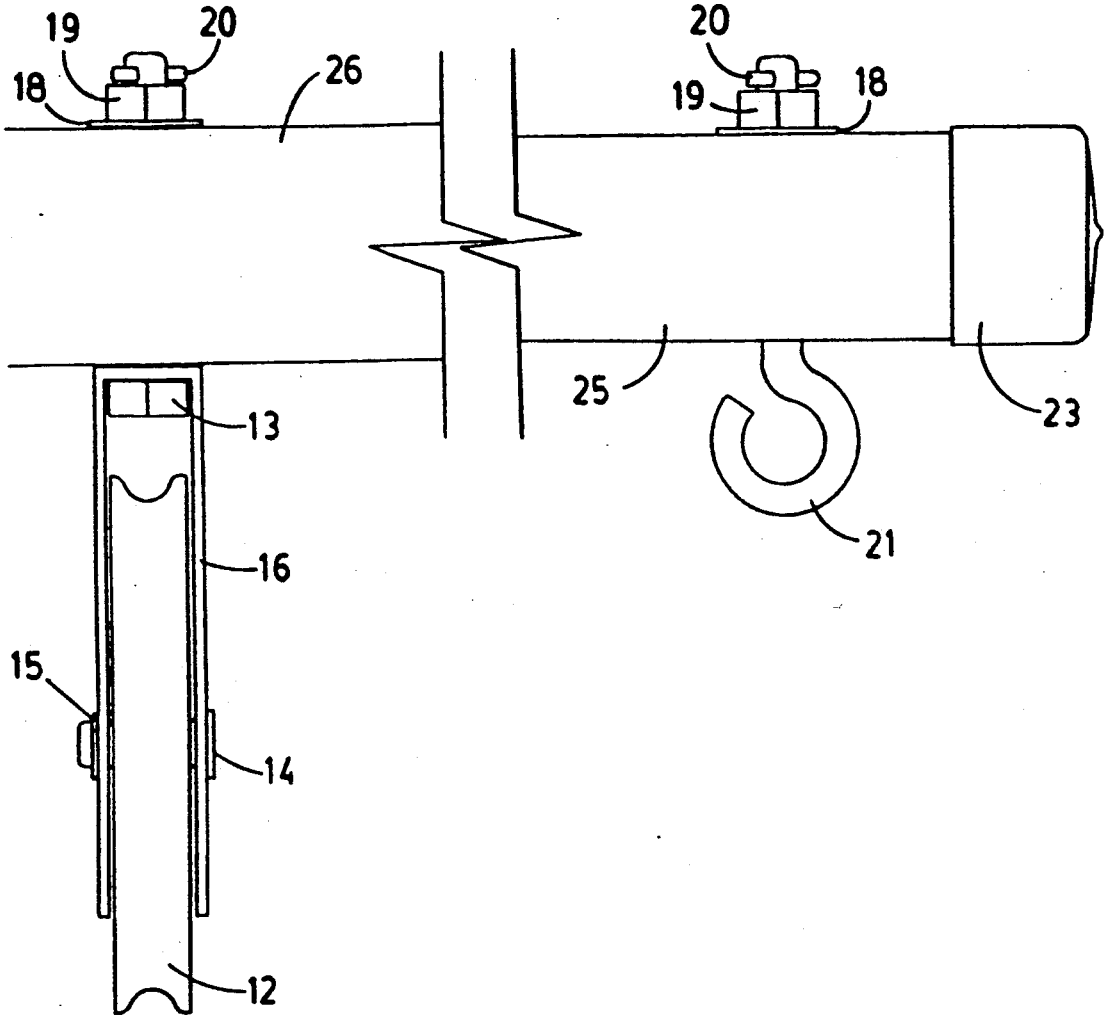
FIG. 3 is a detail elevational view showing the pulley arrangement and first hook illustrated in FIG. 1.

A hook bolt 21, shown in FIGS. 1, 2 and 3, extends up through a hole 30 provided towards one end of the inner tube 25 and is attached to the inner tube by a washer 18, nut 19 and spring clip 20. This is illustrated in FIG. 3.

Figure 4:
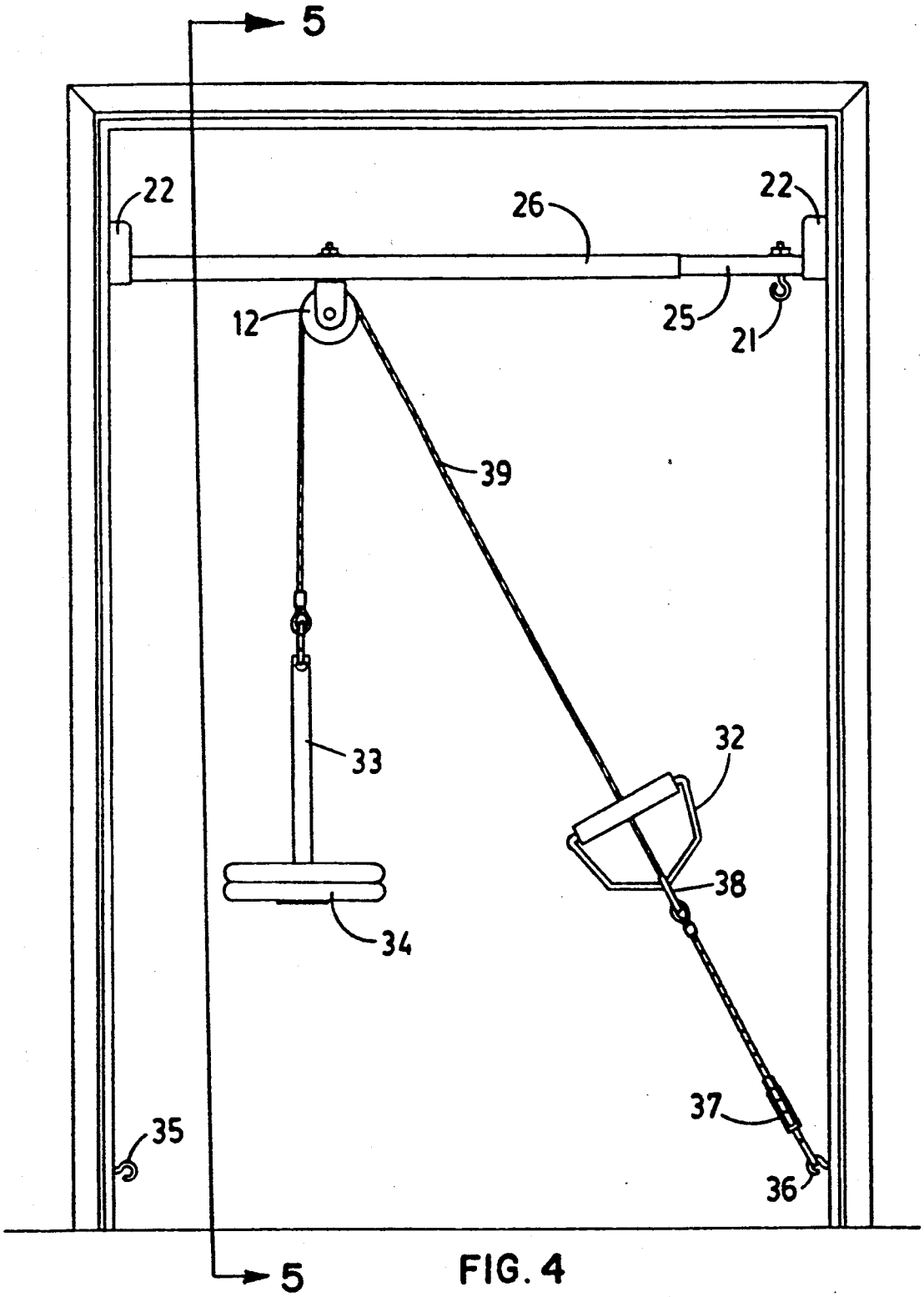
FIG. 4 is a front elevational view of a door frame showing a different arrangement of the components with another movable pulley attached to a hook positioned on one door jamb.
Figure 5:
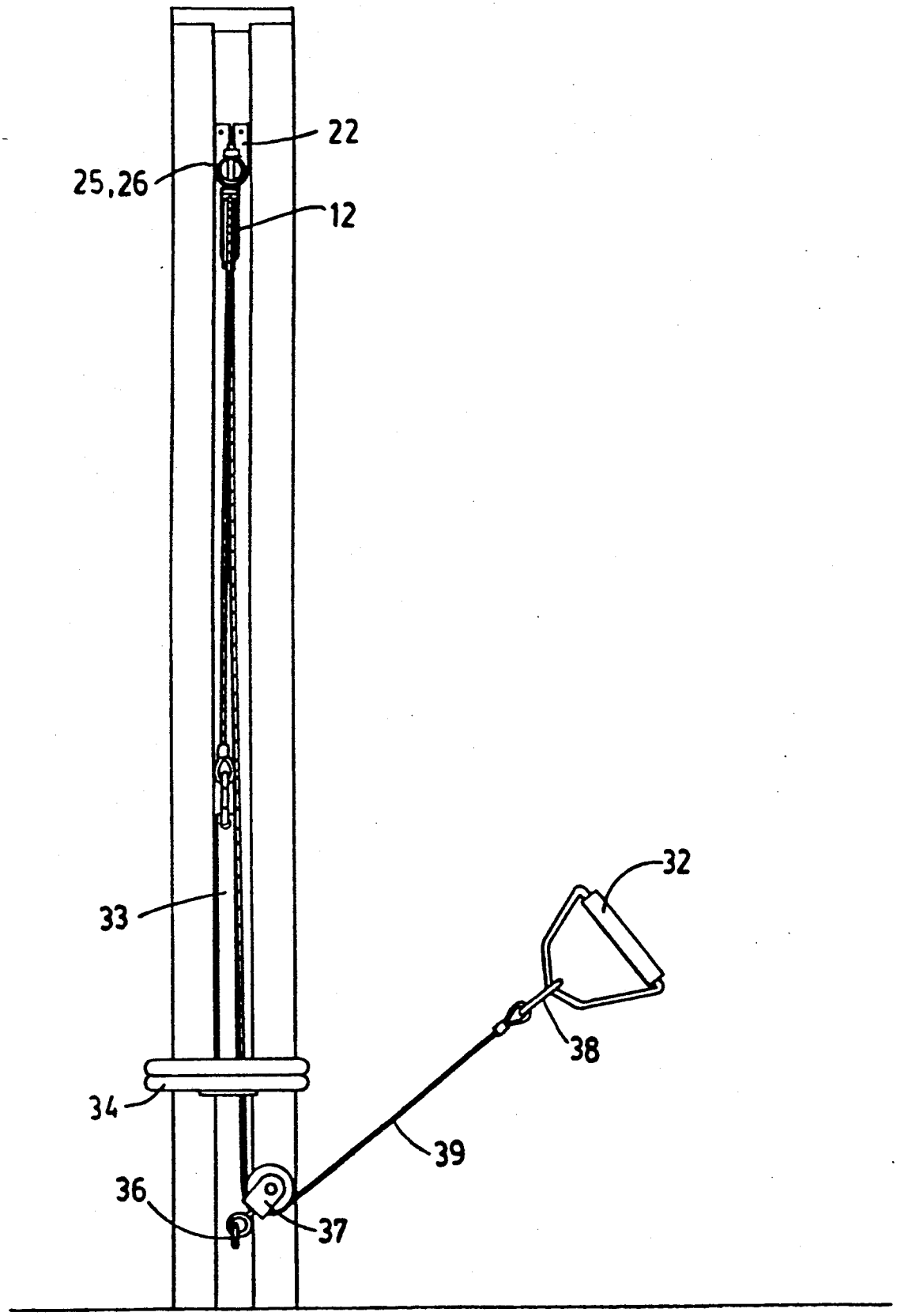
FIG. 5 is a side sectional view taken at line 5—4 of FIG. 4.

FIGS. 4 and 5 illustrate another arrangement of the exercise device wherein the handle 32 provides resistance to upward movement rather than resistance to downward movement as shown in FIG. 1. This is achieved by a second pulley 37 which is attached to a lower hook 36 positioned directly below the brackets 22 in the door jamb. A further lower hook 35 is also illustrated directly opposite the hook 36 whose use will be explained hereafter. The cable 39 passes from the first pulley 12 around the second pulley 37 supported from the hook 36 thus, when the handle 32 is pulled, the cable passes over both pulleys and the weights 34 are raised.

Figure 6:
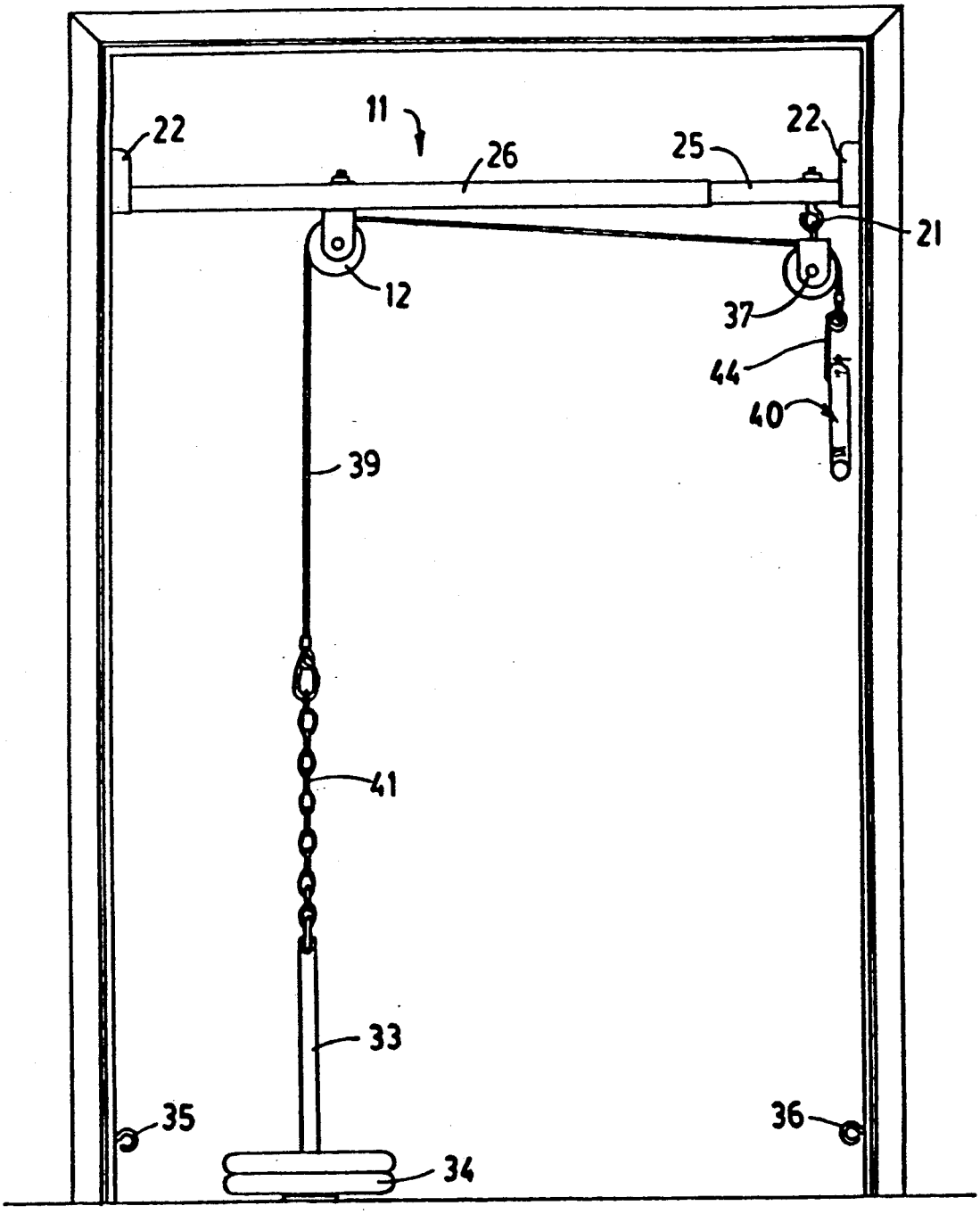
FIG. 6 is a front elevational view of a door frame showing another different arrangement of the components for the exercise device of the present invention.

Another embodiment is shown in FIG. 6 wherein the second pulley 37 is connected to the hook 21 at one end of the chinning bar assembly 11. A second elongate bar 40 or lat bar is connected to the end of the cable 39 by a special clip pin 44. In order to raise the weights 34 the second elongate bar 40 must be forced downwards along the jamb of the doorway. A chain 41 is shown for extending the cable. This also restricts the distance that the weights 34 can be raised as the cable connection at the end to the chain 41 cannot pass through the pulley 12.

Figure 7:
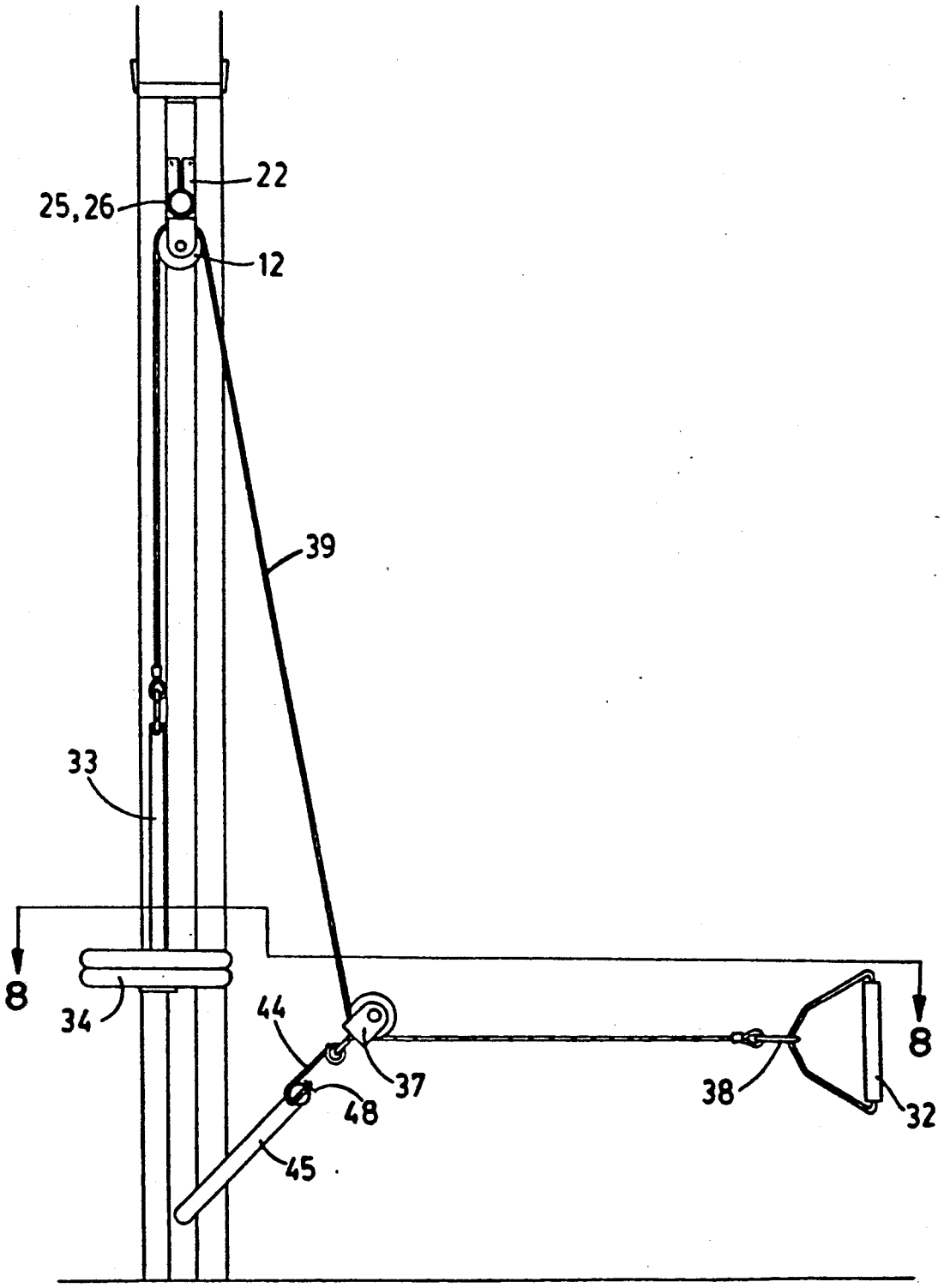
FIG. 7 is a side sectional view of a door frame showing a chinning bar and a lower bar held therein and a different arrangement of a second pulley to provide a longitudinal resistance for a rowing embodiment.
Figure 8:
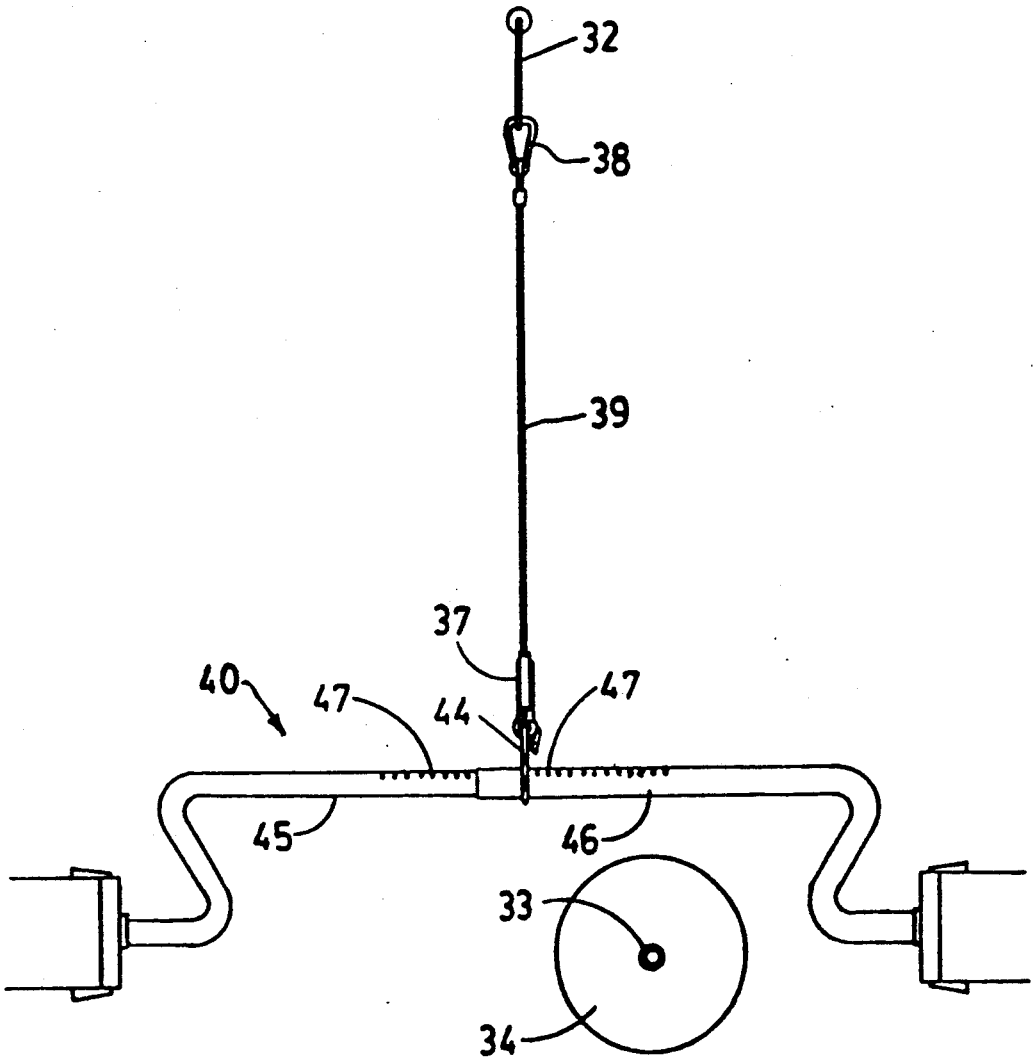
FIG. 8 is a top sectional view taken at line 8—8 of FIG. 7.

FIGS. 7 and 8 show a further arrangement for exercising wherein a lat bar 40 or second elongate bar is shown mounted in a lower position of the doorway. The lat bar 40 comprises an inner tube 45 telescoping within an outer tube 46. Both tubes have Z-shaped configurations so that the center portion of the lat bar 40 is displaced from directly between- the door jambs to permit the weights 34 to lower to the floor without interfering with the lat bar 40. The inner tube 45 and the outer tube 46 are arranged to exactly fit over the two lower hooks 35 and 36 positioned on each side of the door frame in the jambs beneath the brackets 22 supporting the chinning bar 11. A series of holes 47 are provided in both the inner tube 45 and the outer tube 46. Holes in both the bars match and a special clip pin 44 fits through the aligned holes locking the bars together. The lower pulley 37 is attached to this clip 44 and the cable 39 passes over the top or first pulley 12 and the bottom or second pulley 37 extending to the handle 32. This position permits a lateral pull to occur on the handle 32 so that the weights 34 are raised by means of the two pulleys.

Figure 9:
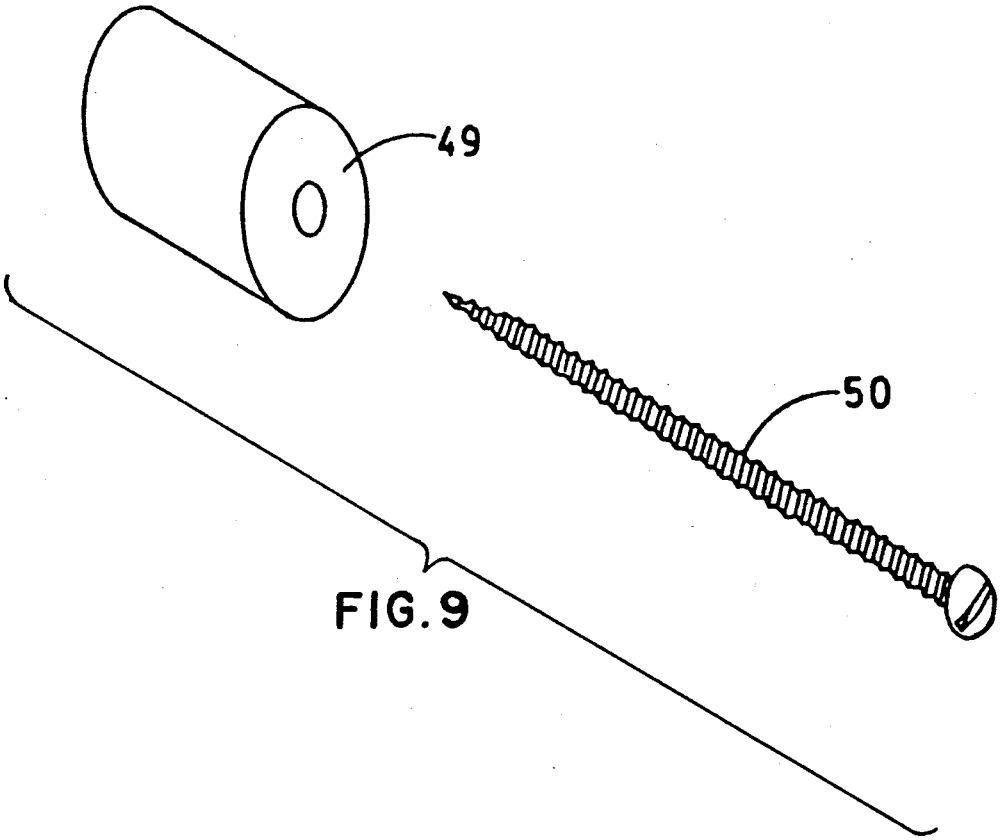
FIG. 9 is a detailed isometric view showing an attachment for securing to a door jamb to support the lower bar.
Figure 10:
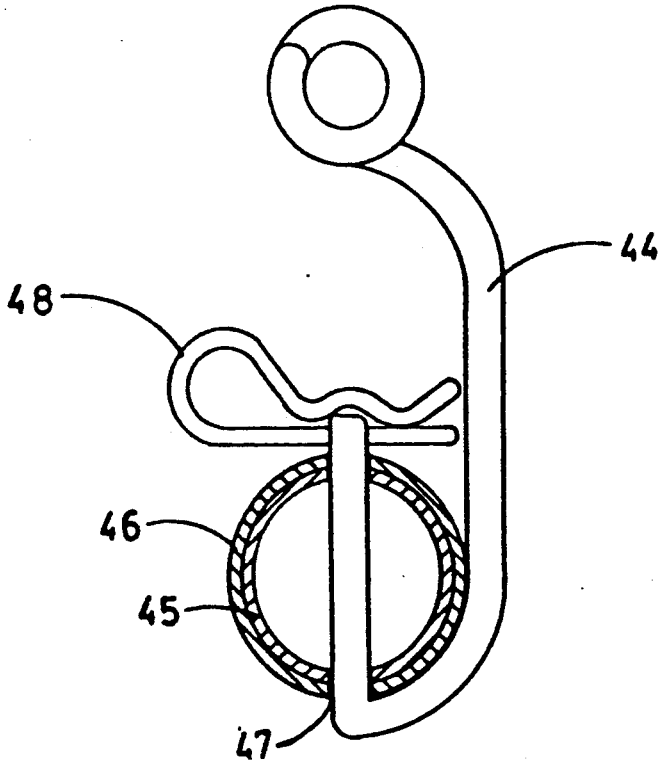
FIG. 10 is a detailed view showing a clip arrangement illustrated in FIGS. 7 and 8 for attaching the second pulley to the lower bar, and to prevent the second elongate bar from increasing and decreasing in length.

In another embodiment the two lower hooks 35 and 36 are replaced by cylindrical members 49 which are shown in FIG. 9 and a screw 50 holds the cylindrical member to the door jambs in the same position as the lower hooks 35 and 36. The ends of the inner and outer tubes 45 and 46 pass over these cylindrical members 49 and are held in place by the cylindrical members. The clip pin 44, as shown in more detail in FIG. 10, has an elongate pin portion which passes through the aligned holes 47 in the inner tube 45 and the outer tube 46 and a spring clip 48 passes through a hole in the end of the elongate portion of the clip pin 44 to hold it in place.

The lat bar 40 has Z-shaped bends in the inner tube 45 and the outer tube 46. This permits a greater variation in the adjustable width due to the overlapping portion of the Z-shaped ends. In the embodiment shown in FIG. 6, the lat bar 40, together with the clip pin 44, is attached to the end of the cable in place of the handle 32 and attachment 38. The two ends of the lat bar 40 are used for both hands or feet in an exercise arrangement.

The ends of the lat bar as shown in FIG. 8 can be used for a foot rest, for instance, when the device is used for a rowing type exercise. This use counters the force on the cable thus restricting the side movement on the door frame. Thus the forces on the door frame are primarily due to the weights 34 pulling down on the chinning bar 11.

Various changes may be made to the embodiment shown herein without departing from the scope of the present invention which is limited only by the following claims.

The embodiments of the present invention in which an exclusive property or privilege is claimed are defined as follows:

1. An exercise device adapted for installation in a doorway, comprising in combination:

a first elongate bar having a telescopically adjustable length, first support means for each end of the first bar, the first support means adapted for attachment on both jambs of the doorway, first pulley supported at a first position on the first elongate bar, weight plate carrier adapted to hold a plurality of weights, cable having a gripping handle at one end passing over the first pulley and at the other end connected to the weight plate carrier, first hook means located at a second position at one end of the first elongate bar, second elongate bar having a telescopically adjustable length and an offset portion adapted to avoid said weight plate carrier when said second bar is installed in said doorway, a second hook means at the approximate center of said second bar, second support means for each end of the second bar, the second support means adapted for attachment on both jambs of the doorway below the first support means, and second pulley for detachably mounting on either the first hook means or the second hook means, the second pulley adapted to allow the cable to pass there around.

2. The exercise device according to claim 1 wherein the second elongate bar comprises an inner tube telescoping within an outer tube, and wherein one of a pair of opposing holes of a plurality of pairs of opposing holes in the outer tube align up with one of a pair of opposing holes in a plurality of pairs of opposing holes in the inner tube, the second hook means including a pin to pass through the aligned holes to prevent the second elongate bar increasing or decreasing in length.

3. The exercise device according to claim 1 wherein the first pulley and second pulley each are supported for rotation about an axis within a U-shaped bracket and have an attachment means extending from the bracket perpendicular to the axis.

4. The exercise device according to claim 1 wherein the first elongate bar comprises an inner tube telescoping within an outer tube and wherein a pair of opposing holes in the outer tube aligns with a pair of opposing holes from a plurality of pairs of opposing holes in the inner tube, including a bolt passing through the aligned holes with locking means to prevent the first elongate bar increasing or decreasing in length.

5. The exercise device according to claim 4 wherein the bolt is rotatable in the aligned holes, and extends from the top of the U-shaped bracket supporting the first pulley for rotation within the bracket.

6. The exercise device according to claim 1 wherein the first support means comprises open topped brackets for supporting the ends of the first elongate bar, the brackets permitting the bar to be removed by lifting, and including attachment means adapted to hold the open topped brackets to jambs of the doorway.

7. The exercise device according to claim 6 including end caps fitting over external ends of the first elongate bar adapted to fit into the open topped brackets attached to the jambs of the doorway.

8. The exercise device according to claim 7 including spacer discs within the end caps beyond the external ends of the first elongate bar providing fine adjustment for length of the first elongate bar.

9. The exercise device according to claim 1 wherein the first hook means comprises an open eye bolt with the bolt passing through a pair of opposing holes in a portion of the first elongate bar.

10. The exercise device according to claim 2 wherein the second support means comprises eye bolts adapted to be attached to jambs of the doorway, the ends of the second elongate bar adapted to fit over the eye bolts and support the second elongate bar in the doorway.

11. The exercise device according to claim 10 wherein one of the eye bolts provides further support means for the second pulley.

12. The exercise device according to claim 2 wherein the pin is a bent wire pin having an open loop for attachment of the second pulley.

13. The exercise device according to claim 1 wherein the second elongate bar has an inner tube telescoping within an outer tube and each tube is bent in a Z-shape to provide the offset portion.

14. The exercise device according to claim 2 wherein the second support means comprises cylindrical members having a diameter smaller than an inside diameter of the inner tube of the second elongate bar, the cylindrical members having attachment means adapted to be attached to jambs of the doorway, the ends of the second elongate bar adapted to fit over the cylindrical members when attached to the jambs of the doorway and support the second elongate bar in the doorway.

* * * * *